US010077142B1

(12) United States Patent
Buzot

(10) Patent No.: US 10,077,142 B1
(45) Date of Patent: Sep. 18, 2018

(54) CONTAINERS WITH PULL-OFF, SNAP-FIT CAPS

(71) Applicant: ELC MANAGEMENT LLC, Melville, NY (US)

(72) Inventor: Hervé Georges Buzot, Mendham, NJ (US)

(73) Assignee: ELC MANAGEMENT LLC, Melville, NY (US)

( * ) Notice: Subject to any disclaimer, the term of this patent is extended or adjusted under 35 U.S.C. 154(b) by 0 days.

(21) Appl. No.: 15/631,027

(22) Filed: Jun. 23, 2017

(51) Int. Cl.

| | |
|---|---|
| ***B65D 41/16*** | (2006.01) |
| ***B65D 47/12*** | (2006.01) |
| ***B65D 41/26*** | (2006.01) |
| *B65D 47/20* | (2006.01) |
| *B05B 11/04* | (2006.01) |

(52) U.S. Cl.
CPC ..... *B65D 41/16* (2013.01); *B65D 41/26* (2013.01); *B65D 47/127* (2013.01); *B05B 11/04* (2013.01); *B65D 47/2037* (2013.01)

(58) Field of Classification Search
CPC .... A47G 19/2272; B65D 41/16; B65D 41/02; B65D 41/26; B65D 11/08; B65D 83/28; B65D 51/18; B65D 47/128; B65D 47/127; B65D 47/12; B65D 47/06; B65D 47/2037; B65D 47/2031; B65D 47/2018; B65D 47/20; B65D 25/40; B65D 25/48
USPC ... 215/44, 43, 216, 224, 221, 217, 329, 316, 215/283, 280, 277, 273, 200, 228; 220/324, 315, 302, 301, 293, 288, 212, 220/254.9, 254.8, 254.1, 259.5, 259.3, 220/256.1, 345.4, 345.1; 222/568, 567, 222/566, 621, 620, 613, 608, 628, 251, 222/372, 153.1
See application file for complete search history.

(56) References Cited

U.S. PATENT DOCUMENTS

| | | | | |
|---|---|---|---|---|
| 3,064,844 | A * | 11/1962 | Hoffmann | B65D 47/12 215/295 |
| 3,630,403 | A * | 12/1971 | Berg | B65D 50/064 215/218 |
| 6,182,822 | B1 | 2/2001 | Albisetti | |
| 6,394,295 | B2 | 5/2002 | Claude | |
| 7,028,858 | B2 | 4/2006 | Auer et al. | |
| 8,365,933 | B2 | 2/2013 | Jackel | |
| 9,254,947 | B2 | 2/2016 | Tada et al. | |
| 9,617,043 | B2 | 4/2017 | McGirr et al. | |
| 2012/0055945 | A1 | 3/2012 | Muhlhausen et al. | |

(Continued)

FOREIGN PATENT DOCUMENTS

| | | |
|---|---|---|
| CN | 103057826 | 4/2013 |
| CN | 202935716 | 5/2013 |
| CN | 203047756 | 7/2013 |

(Continued)

*Primary Examiner* — Robert J Hicks
(74) *Attorney, Agent, or Firm* — Martin Haerter

(57) ABSTRACT

A combined bottle and cap assembly has a cap assembly secured to a bottle by snap-fit engagement. The cap assembly has downwardly directed ramps on an underside and bottle has upwardly directed ramps on a top wall. When the cap assembly is rotated relative to the bottle, the downwardly directed ramps cooperatively engage the upwardly directed ramps to lift the cap assembly from the bottle sufficiently to disengage the snap-fit engagement and allow cap assembly to be easily lifted from the bottle.

11 Claims, 7 Drawing Sheets

(56) References Cited

U.S. PATENT DOCUMENTS

| | | | |
|---|---|---|---|
| 2016/0176590 | A1 | 6/2016 | Prater et al. |
| 2017/0066565 | A1 | 3/2017 | Park |

FOREIGN PATENT DOCUMENTS

| | | |
|---|---|---|
| CN | 203231215 | 10/2013 |
| CN | 104609013 | 5/2015 |
| CN | 103449006 | 8/2015 |
| CN | 205470560 | 8/2016 |
| CN | 205819899 | 12/2016 |
| DE | 102008017468 | 8/2015 |
| FR | 2781133 | 1/2000 |
| JP | 4899209 | 3/2012 |
| JP | 2013-95486 | 5/2013 |
| JP | 5560395 | 7/2014 |
| JP | 2015-48122 | 3/2015 |
| JP | 5966240 | 8/2016 |
| JP | 5975384 | 8/2016 |
| JP | 2016-179862 | 10/2016 |
| WO | WO-2009121582 | 10/2009 |
| WO | WO-2017/108697 | 6/2017 |

* cited by examiner

CONTAINERS WITH PULL-OFF, SNAP-FIT CAPS

BACKGROUND OF THE INVENTION

Field of the Invention

The present invention relates to containers with pull off, snap-fit caps. In particular, the present invention is directed to a container with a close tolerance pull off cap having ramps that interact to lift the cap sufficiently to free the cap from snap-fit engagement to the container.

Description of the Prior Art

The shapes of contemporary cap and bottle combinations tend to be sleek, with aesthetic considerations often taking precedent over functional aspects. Surfaces are smooth and gaps between bottle and cap are minimized to provide a near seamless appearance that is more luxurious, sculpted and appealing to consumers. Making and using such designs can yield challenges. On the manufacturing side, for example, achieving the close fit of components can be challenging due to differences in manufacturing tolerances for such materials as plastic and glass. Bottles made of glass have may have significantly larger variance in specifications than do plastic components due to mold and material tolerance considerations. Accordingly, when a cap assembly made of plastic is installed on a glass bottle, it can be difficult to achieve a close, snug fit of the components. With respect to use issues, for example, the smooth surfaces and snug fit of components of more contemporary designs may not provide sufficient surface topography for gripping either the cap or bottle. Also, for example, when the gap between the bottle and cap are minimized, it may be difficult for a consumer to insert fingers under the cap to pry the cap from the bottle. Accordingly, it may at times be difficult for a user to remove the cap from the bottle.

Accordingly, there is a need for a bottle and cap combination that allows for a close fit of components during assembly and also is easy for an end user to open and close.

BRIEF SUMMARY OF THE INVENTION

It is an object of the invention to provide a bottle and cap combination that assembles easily with close tolerances between components of different materials.

It is a further object of the invention to make the cap readily and easily removable from the bottle.

To overcome the problems of the prior art and achieve the objects of the invention, a cap assembly is provided with inner and outer components that are adjustable with respect to each other during the initial assembly on the bottle. The inner component moves onto a collar on the bottle until it reaches a predetermined stopping point, at which point the inner component is secured to the bottle by snap-fit engagement. Subsequently, the outer component is moved downwardly on the inner component until a minimum gap is achieved between the bottom of the outer component and the top surface of the bottle. As the gap is minimal, removing the cap may be difficult because the user cannot insert fingers under the cap to lift the cap. Accordingly, the cap is provided with downwardly directed ramps on an underside and the bottle is provided with upwardly directed ramps on a top wall. When the cap is rotated relative to the bottle, the downwardly directed ramps cooperatively engage the upwardly directed ramps to lift the cap from the bottle sufficiently to disengage the snap-fit engagement and allow cap to be easily lifted from the bottle.

The invention allows the cap to be positioned on the container in a snug manner wherein the bottom of the outer cap always comes in close proximity to the shoulder of the bottle. In this way any potential esthetic or functional gap between cap assembly and the bottle is minimized or eliminated. The invention also allows the cap to easily open and come loose upon twisting the cap assembly relative to the bottle.

DETAILED DESCRIPTION OF THE INVENTION

Figure 13:
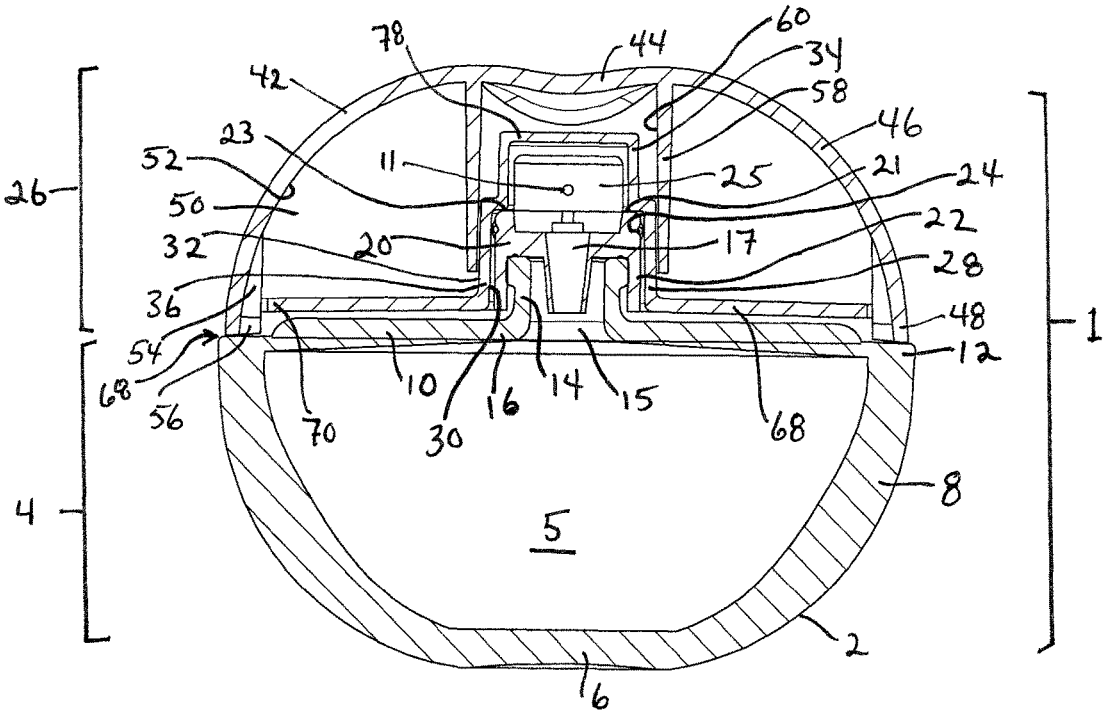
FIG. 13 is a front elevation sectional view of the bottle and cap assembly.

Referring now to FIGS. 1-13, the bottle and cap assembly, or container, is shown generally at reference number 1. The bottle and cap assembly 1 includes a bottle 2 having a container portion 4 defining a reservoir 5 (see FIG. 13). The container portion 4 is defined by a bottom wall 6, a circumferential side wall 8 and a top wall 10. A circumferential shoulder 12 is defined at an intersection of the side wall 8 and the top wall 10. A neck 14 (see FIG. 13) extends up from a center 16 of the top wall 10. The neck 14 defines a passage 15 (see FIG. 13) that provides fluid communication between the reservoir 5 and a pump 17. A lift ramp 18 extends up from the top wall 10 adjacent the shoulder 12.

A collar 20 is secured to and encloses at least a portion of the neck 14. The pump 17 is secured to the collar. An actuator button 25 is movably secured in fluid communication to the top of the pump 17. The actuator button 25 has a nozzle 11 for dispensing product from the reservoir 5. The collar has a top surface 21 that defines an upwardly directed peripheral edge 23 and an outwardly directed side surface 22. The side surface 22 has an outwardly opening circumferential snap groove 24.

A cap assembly 26 is provided that can be selectively secured to the collar 20 of the bottle 2 by snap-fit engagement. The cap assembly 26 has a vertical inner sleeve 28, also referred to herein as an inner component. The inner sleeve 28 has an inner surface 30, an outer surface 32, an upper end 34 and a lower end 36. An upper portion 37 of the inner sleeve 28 has a first internal dimension. A lower portion 38 of the inner sleeve has a second internal dimension that is wider than the first internal dimension of the upper portion 37. A transition 39 of the inner surface 30 from the first internal dimension of the upper portion 37 to the wider second internal dimension of the lower portion 38 defines a downwardly directed stop wall 41. The second internal dimension of the lower portion 38 of the inner sleeve 28 is selected to fit closely around the collar 20 in sliding engagement. The inner surface 30 of the lower portion 38 has at least one inwardly directed snap bead 40 (see FIG. 2) dimensioned to be received in snap-fit engagement in the snap groove 24 on the collar 20. Preferably, two or more snap beads 40 are provided on the inner sleeve 28 spaced around in a circumferentially discontinuous arrangement. Alternatively, the snap bead may be a single snap bead that is circumferentially continuous on the inner sleeve 28.

The cap assembly 26 also has an outer component, an outer cap 42, comprising a top end wall 44 and a circumferential outer wall 46 depending from the top end wall 44 to a bottom end 48. The outer wall 46 defines a downwardly directed cavity 50 with an interior surface 52. A strut 54 depends downwardly and inwardly from the interior surface 52 near the bottom end 48 of the outer wall. The strut 54 terminates in a chisel-shaped, downwardly directed thrust ramp 56. The outer cap 42 also has a circumferential inner wall 58 depending from the top end wall 44 into the cavity 50. The inner wall 58 is dimensioned so that during initial installation of the cap assembly 26 on the collar 20, an inside surface 60 of the inner wall 58 initially engages the outer surface 32 of the inner sleeve 28 in a first elevated temporary position 62 (see FIGS. 2-4). The inner wall remains in the elevated position 62 as the cap assembly 26 is moved downwardly onto the collar 20 until the downwardly directed stop wall 41 abuts the upwardly directed peripheral edge 23 (see FIG. 3), and the snap bead 40 engages the snap groove 24. When the inner sleeve 28 stops moving downward relative to the collar 20, i.e., when the stop wall 41 abuts the peripheral edge 23 of the collar 20, the inner wall 58 can continue to be pushed downwardly relative to the inner sleeve 28 to a second lower permanent position 64 (see FIG. 1) on the inner sleeve 28 such that a gap 68 between the bottom end 48 of the outer wall 46 and the shoulder 12 of the bottle 2 is substantially or completely closed. In this manner, the outer component, outer cap 42, is moved to its final position on the inner component, inner sleeve 28.

Figure 9:
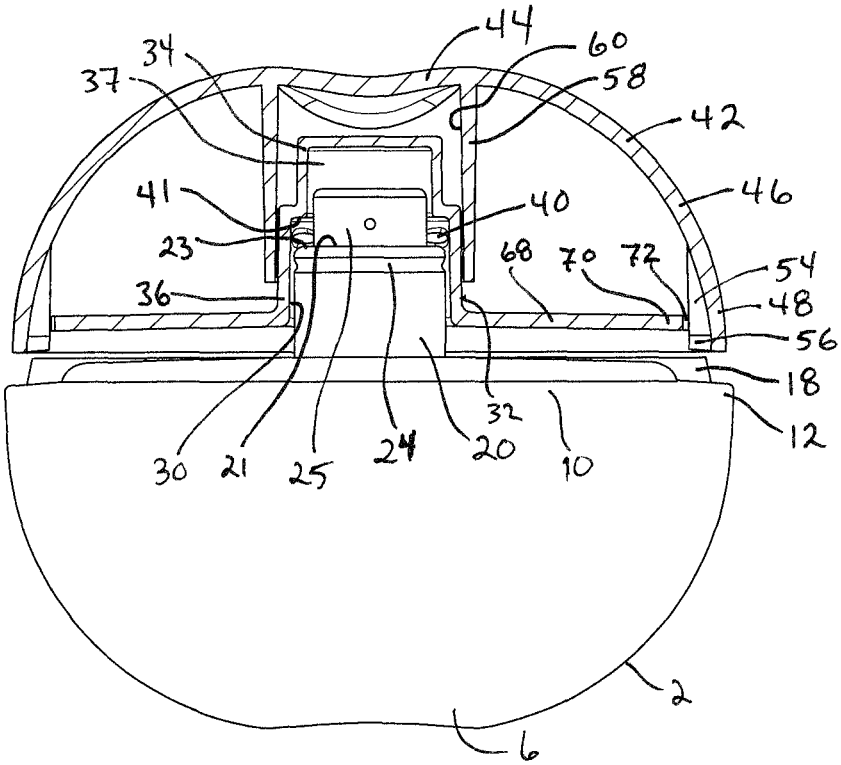
FIG. 9 is a front elevation and partial sectional view of the bottle and cap assembly after cooperative engagement of the ramps has caused the cap to lift sufficiently to disengage the cap assembly from snap-fit engagement with the bottle.
Figure 10:
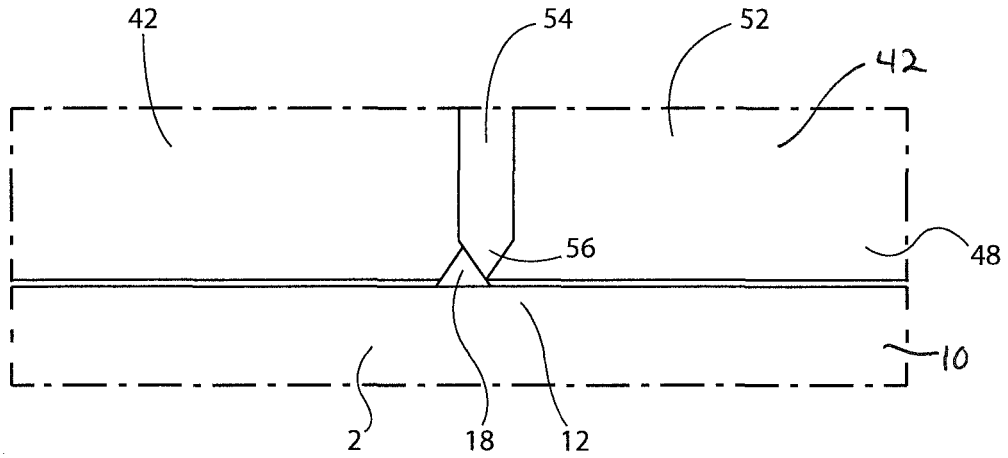
FIG. 10 is an enlarged elevation view of the ramps when the cap assembly is in snap-fit engagement with the bottle.
Figure 11:
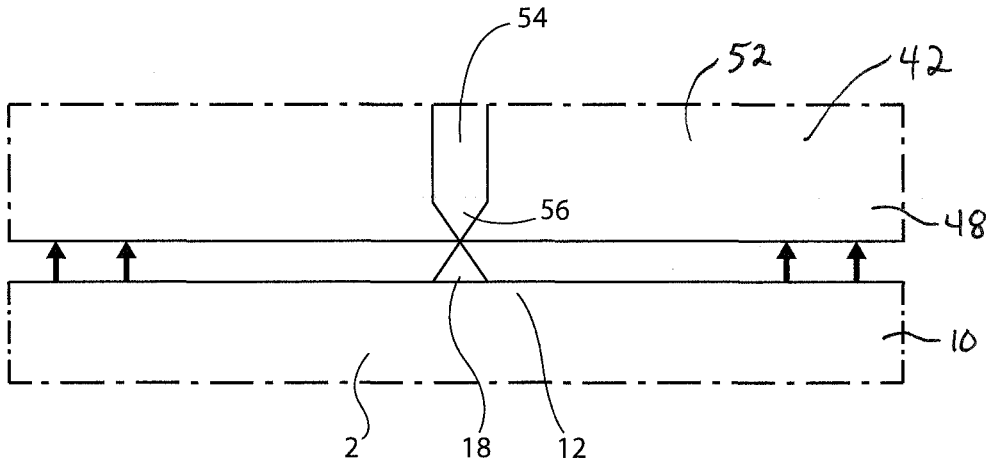
FIG. 11 is an enlarged elevation view of the ramps when the cap assembly is disengaged from snap-fit engagement with the bottle.
Figure 12:
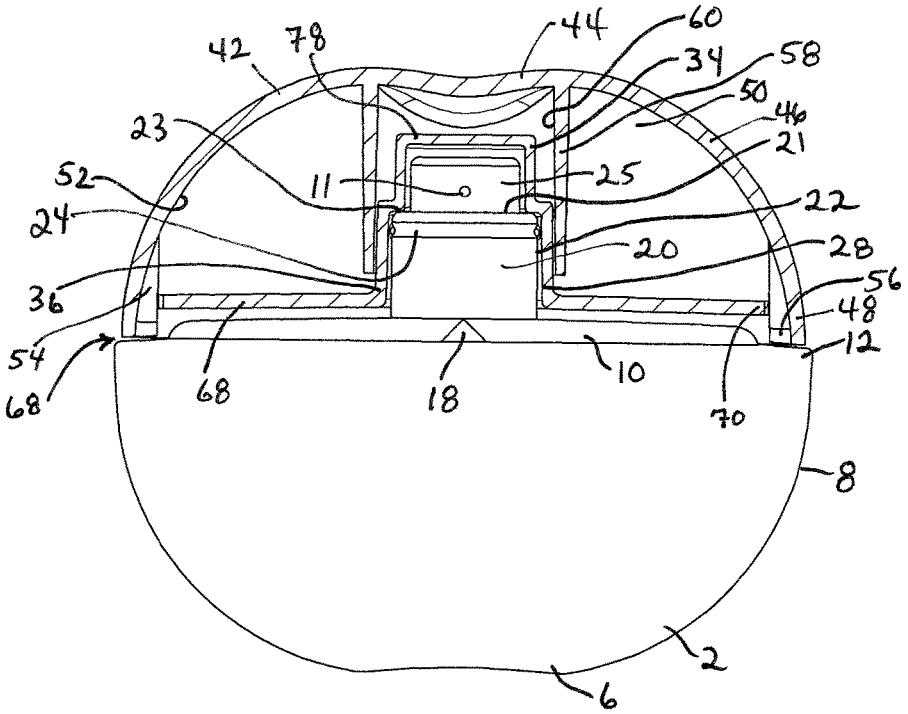
FIG. 12 is an alternate embodiment of the invention shown in FIG. 1.

The cap assembly 26 can be readily, selectively removed from snap-fit engagement to the bottle 2 by rotating the cap assembly 26 relative to the bottle 2 until the thrust ramp 56 engages and slides up on the lift ramp 18 (see FIGS. 10-11) causing the cap assembly 26 to lift relative to the top wall 10 of the bottle 2 sufficiently to disengage the snap bead 40 from the snap groove 24 (see FIG. 9). To ensure proper functionality, the force required for snap-fit engagement or disengagement of the snap bead to/from the snap groove is selected to be relatively low so that the cap assembly is easily removable from the bottle, and the force required to engage the inner sleeve to the inner wall is relatively higher (i.e., significantly greater than the snap fit engagement/disengagement forces) to ensure that after initial installation on the bottle, the inner and outer cap assembly components do not inadvertently separate, e.g., during cap removal.

The cap assembly 26 may further have a cap liner 68 extending outwardly from the lower end 36 of the inner sleeve 28 to a rim edge 70. The rim edge 70 is preferably adjacent the bottom end 48 of the outer wall 46 of the outer cap 42 such that the cavity 50 is substantially concealed from view when the cap assembly 26 is removed from the bottle 2 and inverted.

Figure 1:
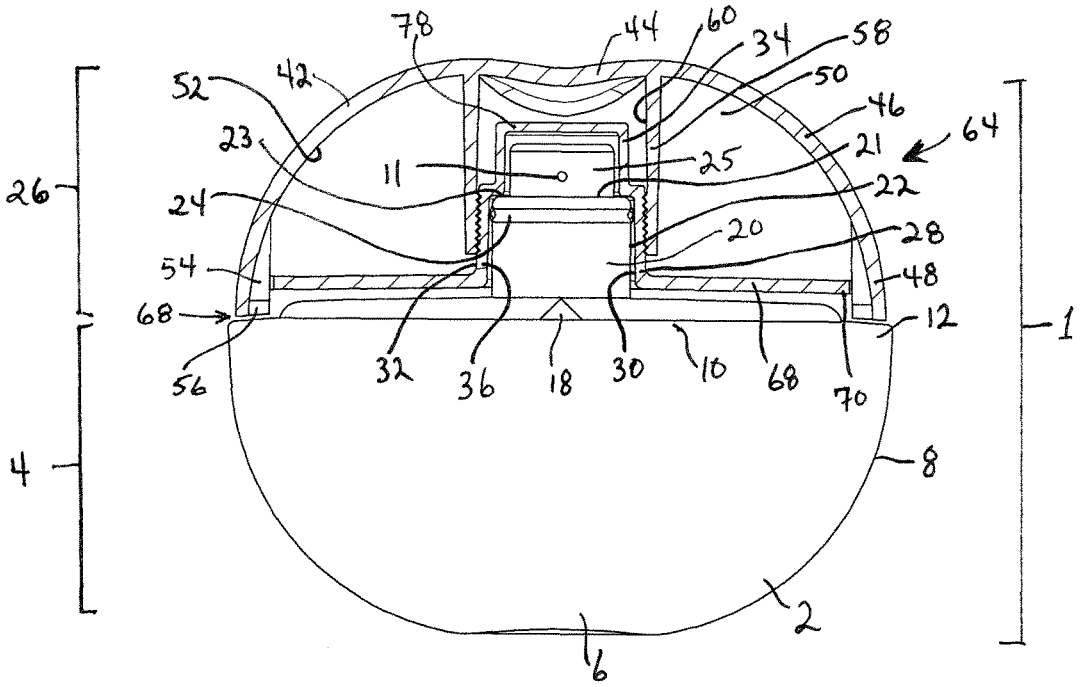
FIG. 1 is a front elevation and partial sectional view of the bottle and cap assembly of the invention.
Figure 2:
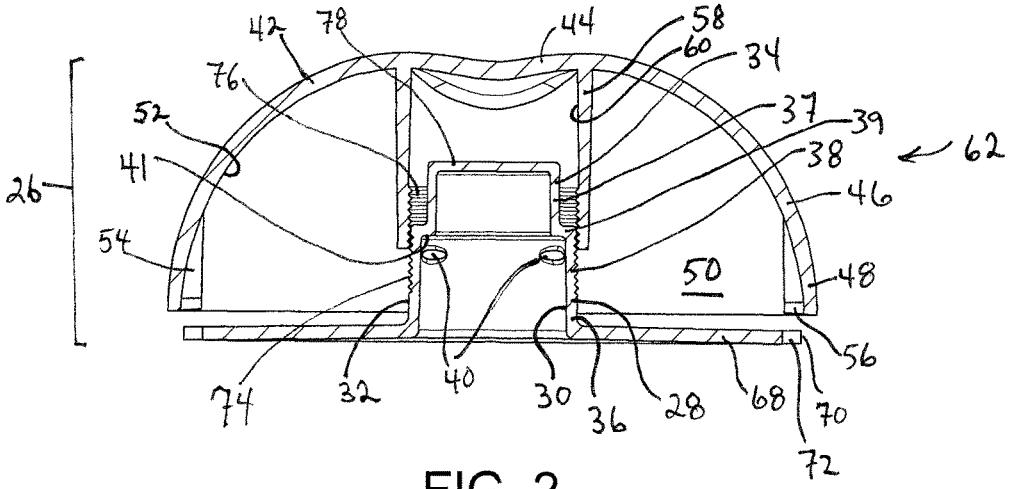
FIG. 2 is a front elevation sectional view of the cap assembly prior to initial installation on the bottle.
Figure 3:
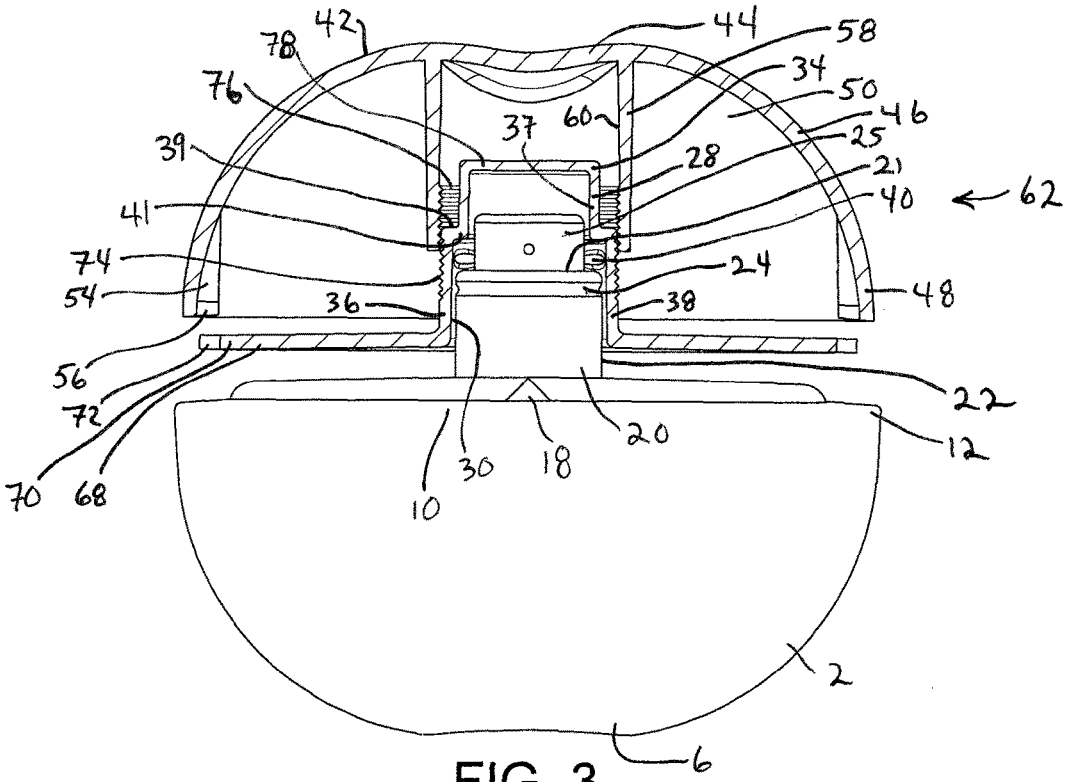
FIG. 3 is a front elevation and partial sectional view of the bottle and cap assembly in the first stage of assembly.
Figure 4:
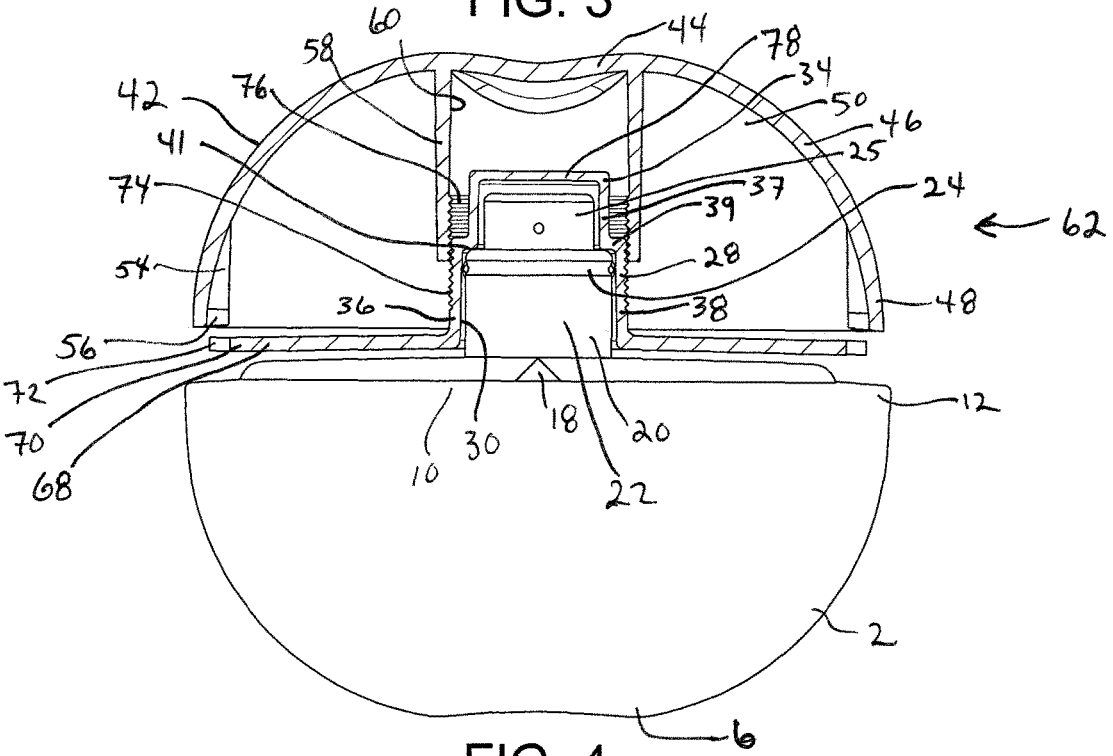
FIG. 4 is a front elevation and partial sectional view of the bottle and cap assembly in the second step of assembly.
Figure 5:
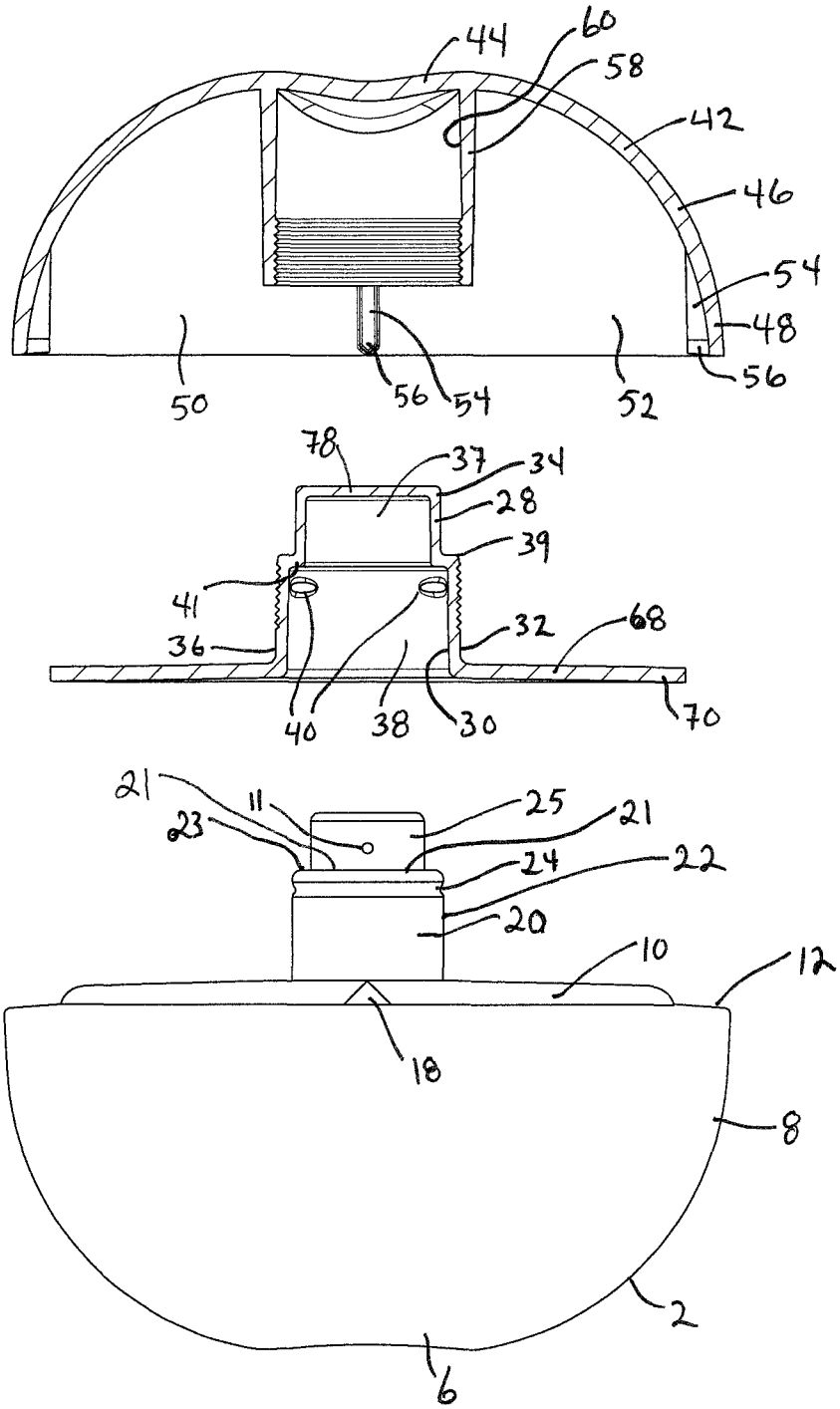
FIG. 5 is an exploded view of the bottle and cap assembly.
Figure 6:
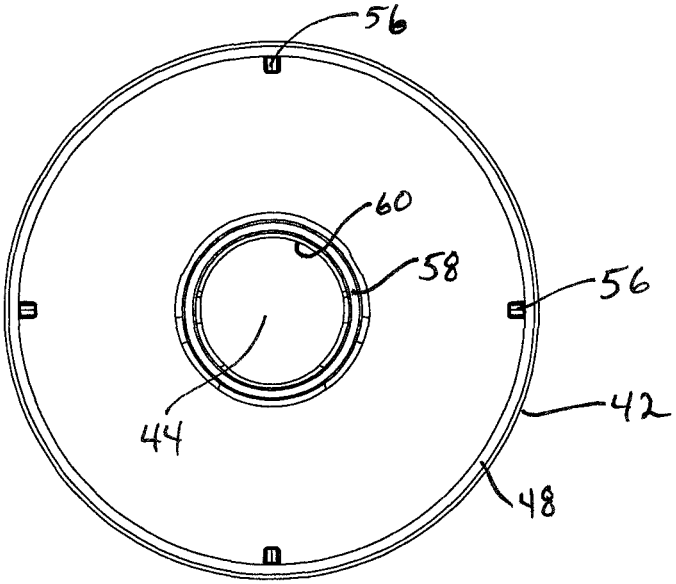
FIG. 6 is a bottom plan view of the cap assembly.
Figure 7:
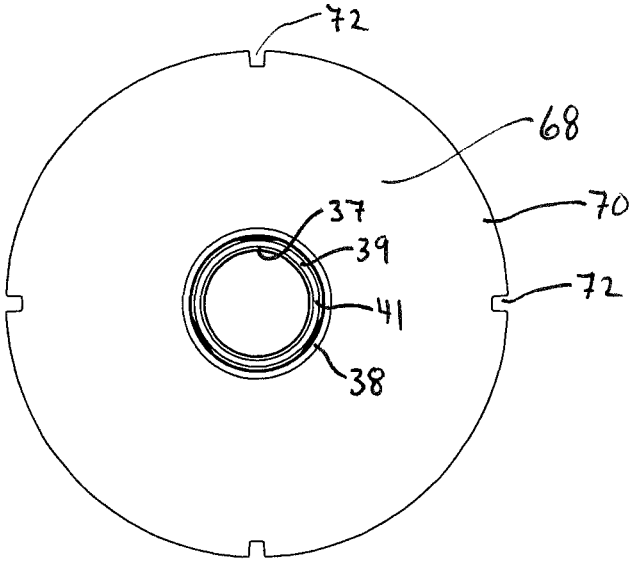
FIG. 7 is a bottom plan view of the cap liner.
Figure 8:
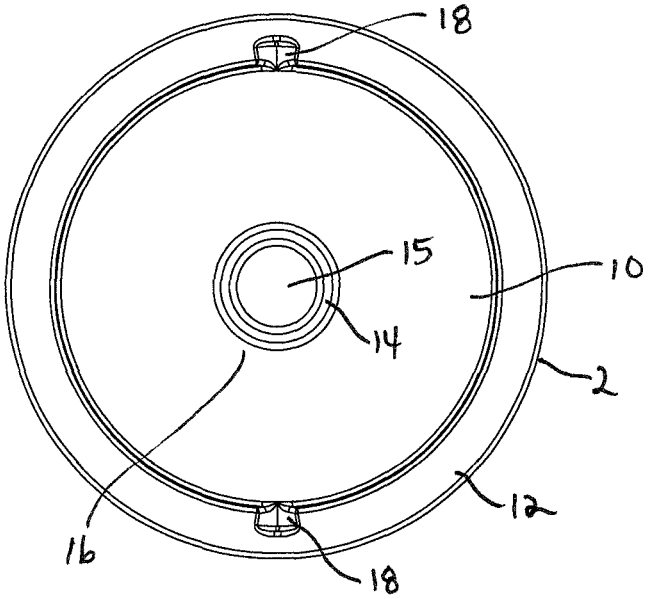
FIG. 8 is a top plan view of the bottle.

The rim edge 70 of the cap liner 68 preferably has an outwardly opening gap or clearance 72 (best illustrated in FIG. 7). The clearance 72 is dimensioned to accommodate a cross-section of the strut 54 on the interior surface 52 of the outer cap 42.

The inside surface 60 of the inner wall 58 may securely engage the outer surface 32 of the inner sleeve 28 by, for example, force-fit engagement, i.e., by interference fit (see FIG. 9). The interference fit can be facilitated with rough surface features or topography, or with ribs. Alternatively, the inside surface 60 may be adhered to the outer surface 32 of the inner sleeve 28 by glue, welding or other suitable means.

Preferably, a vertical array of outwardly directed, horizontal ratchet teeth 74 may be provided on at least a portion of the outer surface 32 of the inner sleeve 28, and a vertical array of inwardly directed pawl teeth 76 may be provided on the inner wall 58 opposite the ratchet teeth 74. The pawl teeth 76 are dimensioned to be received in ratcheting engagement with the ratchet teeth 74 to hold the inner wall 58 in the first temporary position 62 and the second final position 64 on the inner sleeve 28. Preferably, the ratcheting engagement of the pawl teeth 76 and ratchet teeth 74 is operative in moving the inner wall 58 relative to the inner sleeve 28 solely in a downward direction. Each of the teeth in the vertical array of ratchet teeth 74 may be circumferentially continuous on the outer surface 32 of the inner sleeve 28. Or, each of the teeth in the vertical array of ratchet teeth 74 may be circumferentially segmented.

The inner sleeve 28 may have a horizontal upper end wall 78 to close the upper end 34 of the inner sleeve 28, to, for example, form an inner cap enclosing the actuator button 25.

The bottle 2 may be made of any suitable material, such as, for example, glass, metal or plastic. The collar 20 and inner and outer cap assembly 26 components may be made of a suitable plastic material such as, for example, poly propylene, acrylonitrile butadiene styrene, or other suitable material. Preferably, the inner components are made of a relatively softer plastic material and the outer components are made of a relatively more rigid plastic material.

The invention is unique in that the cap-to-container gap, typically found in packaging assemblies where an inner component is snap-fit around a pump collar in a fixed position relative to the container, gets eliminated by making the outer cap to inner sleeve assembly movably friction fitted wherein the outer cap can be pushed down during assembly and slide down and over the inner sleeve all the way until it bottoms out and contacts the container shoulder.

The invention is unique as it ensures that the cap to collar snap-fit removal force stays low and usable for consumers while the outer cap inner wall to inner sleeve engagement removal force stays high and secures the positioning and proper assembly of the whole cap assembly. The invention is further unique because parts of the outer cap or inner sleeve that come in contact with or close to the container surface have ramp features (thrust ramps) that interact with reciprocally positioned bottle ramps and allow for the entire cap assembly to lift upwards when the cap assembly is rotated relative the bottle. This facilitates release of the snap-fit bead from the snap fit groove to free the cap and allow the consumer to easily access the container pump, or the container directly (through dispensing passage 15 if no pump is present).

It is understood that various modifications and changes in the specific form and construction of the various parts can be made without departing from the scope of the following claims.

What is claimed is:

1. A combined bottle and cap assembly (1) comprising:

a bottle (2) having a container portion (4) defined by a bottom wall (6), a circumferential side wall (8) and a top wall (10), a circumferential shoulder (12) defined at an intersection of the side wall (8) and the top wall (10), a neck (14) extending upwardly from a center (16) of the top wall (10), and a lift ramp (18) extending upwardly from the top wall (10) adjacent the shoulder (12);

a collar (20) secured to and enclosing at least a portion of the neck (14), the collar having a top surface (21) defining an upwardly directed peripheral edge (23) and an outwardly directed side surface (22), the side surface (22) having an outwardly opening circumferential snap groove (24);

a cap assembly (26) comprising:

a vertical inner sleeve (28) with an inner surface (30), an outer surface (32), an upper end (34), a lower end (36), an upper portion (37) having a first internal dimension and a lower portion (38) having a second internal dimension wider than the first internal dimension, a transition (39) of the inner surface (30) from the first internal dimension of the upper portion (37) to the second internal dimension of the lower portion (38) defines a downwardly directed stop wall (41), the second internal dimension of the lower portion (38) of the inner sleeve (28) selected to fit closely around the collar (20) in sliding engagement, the inner surface (30) of the lower portion (38) having an inwardly directed snap bead (40) dimensioned to be received in snap-fit engagement in the snap groove (24) on the collar (20); and an outer cap (42) comprising a top end wall (44), a circumferential outer wall (46) depending from the top end wall (44) to a bottom end (48), the outer wall (46) defining a downwardly directed cavity (50) with an interior surface (52), a strut (54) downwardly and inwardly depending from the interior surface (52) near the bottom end (48), the strut (54) terminating in a downwardly directed thrust ramp (56), and a circumferential inner wall (58) depending from the top end wall (44) into the cavity (50), the inner wall (58) dimensioned so that during initial installation of the cap assembly (26) on the collar (20), an inside surface (60) of the inner wall (58) initially engages the outer surface (32) of the inner sleeve (28) in a first elevated temporary position (62) and remains in the elevated position (62) as the cap assembly (26) is moved downwardly onto the collar (20) until the downwardly directed stop wall (41) abuts the upwardly directed peripheral edge (23) and the snap bead (40) engages the snap groove (24), wherein the inner sleeve (28) stops moving downward relative to the collar (20) and the inner wall (58) continues to move downwardly relative to the inner sleeve (28) to a second lower permanent position (64) on the inner sleeve such that a gap (68) between the bottom end (48) of the outer wall (46) and the shoulder (12) of the bottle (2) is substantially closed; and wherein the cap assembly (26) can be readily removed from the bottle (2) by rotating the cap assembly (26) relative to the bottle (2) until the thrust ramp (56) engages and slides up on the lift ramp (18) causing the cap assembly (26) to lift relative to the top wall (10) of the bottle (2) sufficiently to disengage the snap bead (40) from the snap groove (24).

2. The combined bottle and cap assembly of claim 1 further having a cap liner (68) extending outwardly from the lower end (36) of the inner sleeve (28) toward a rim edge (70) adjacent the bottom end (48) of the outer wall (46) of the outer cap (42) such that the cavity (50) is substantially concealed.

3. The combined bottle and cap assembly of claim 2 wherein the rim edge (70) of the cap liner (68) has an outwardly opening clearance (72) dimensioned to accommodate a cross-section of the strut (54).

4. The combined bottle and cap assembly of claim 1 wherein the inside surface (60) of the inner wall (58) engages the outer surface (32) of the inner sleeve (28) by force-fit engagement.

5. The combined bottle and cap assembly of claim 1 further comprising a vertical array of outwardly directed ratchet teeth (74) on at least a portion of the outer surface (32) of the inner sleeve (28), and a vertical array of inwardly directed pawl teeth (76) on the inner wall (58) opposite the ratchet teeth (74), the pawl teeth (76) dimensioned to be received in ratcheting engagement with the ratchet teeth (74) to hold the inner wall (58) in the first temporary position (62) and the second final position (64) on the inner sleeve (28).

6. The combined bottle and cap assembly of claim 1 wherein the snap bead is circumferentially continuous.

7. The combined bottle and cap assembly of claim 1 wherein the snap bead is circumferentially discontinuous.

8. The combined bottle and cap assembly of claim 5 wherein the vertical array of ratchet teeth is circumferentially continuous.

9. The combined bottle and cap assembly of claim 5 wherein the vertical array of ratchet teeth is circumferentially segmented.

10. The combined bottle and cap assembly of claim 1 wherein the inner sleeve (28) has a horizontal upper end wall (78) closing the upper end (34) of the inner sleeve (28).

11. The combined bottle and cap assembly of claim 5 wherein the ratcheting engagement of the pawl teeth (76) and ratchet teeth (74) is operative in moving the inner wall (58) relative to the inner sleeve (28) solely in a downward direction.

* * * * *